US011813868B2

(12) United States Patent
Haga et al.

(10) Patent No.: US 11,813,868 B2
(45) Date of Patent: Nov. 14, 2023

(54) LIQUID DISCHARGE DEVICE AND MAINTENANCE METHOD OF LIQUID DISCHARGE DEVICE

(71) Applicant: SEIKO EPSON CORPORATION, Tokyo (JP)

(72) Inventors: Masato Haga, Shiojiri (JP); Tadahiro Mizutani, Shiojiri (JP); Yasuaki Hirai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 16 days.

(21) Appl. No.: 17/557,740

(22) Filed: Dec. 21, 2021

(65) Prior Publication Data

US 2022/0194083 A1 Jun. 23, 2022

(30) Foreign Application Priority Data

Dec. 22, 2020 (JP) ..... 2020-212370

(51) Int. Cl.
*B41J 2/165* (2006.01)

(52) U.S. Cl.
CPC ..... *B41J 2/165* (2013.01); *B41J 2/16532* (2013.01); *B41J 2002/16573* (2013.01)

(58) Field of Classification Search
CPC ..... B41J 2/165; B41J 2/16532; B41J 2002/16573; B41J 2/16508
See application file for complete search history.

(56) References Cited

U.S. PATENT DOCUMENTS

2017/0165971 A1* 6/2017 Igarashi ..... B41J 2/16538

FOREIGN PATENT DOCUMENTS

| | | | | |
|---|---|---|---|---|
| JP | 2000289229 A | | 10/2000 | |
| JP | 3674036 B2 | * | 7/2005 | ..... B41J 2/16508 |
| JP | 3884878 B2 | * | 2/2007 | ..... B41J 2/16532 |
| JP | 2008114400 A | | 5/2008 | |

* cited by examiner

*Primary Examiner* — Sharon Polk
(74) *Attorney, Agent, or Firm* — CHIP LAW GROUP

(57) ABSTRACT

A liquid discharge device includes a discharge unit configured to discharge liquid, a maintenance unit configured to cause the discharge unit to eject liquid to perform maintenance of the discharge unit, and a control unit configured to cause the maintenance unit to perform the maintenance periodically, wherein when performing the maintenance, the control unit performs first maintenance in a case in which a consumption amount of the liquid consumed after the maintenance previously performed is greater than or equal to a first threshold value, and performs second maintenance stronger than the first maintenance in a case in which the consumption amount is less than the first threshold value.

8 Claims, 7 Drawing Sheets

LIQUID DISCHARGE DEVICE AND MAINTENANCE METHOD OF LIQUID DISCHARGE DEVICE

The present application is based on, and claims priority from JP Application Serial Number 2020-212370, filed Dec. 22, 2020, the disclosure of which is hereby incorporated by reference herein in its entirety.

BACKGROUND

1. Technical Field

The present disclosure relates to a liquid discharge device such as a printer and a maintenance method of the liquid discharge device.

2. Related Art

For example, as in JP-A-2000-289229, there is a recording device, an example of a liquid discharge device. The recording device discharges ink, an example of liquid, and performs printing from a recording head, an example of an discharge unit. The recording device includes a capping means and a suction pump. The capping means caps the recording head. The suction pump performs recovery operation, which is an example of maintenance, by creating a negative pressure in the capping means that caps the recording head. When a time elapsed from the previous recovery operation is long, the suction pump performs the recovery operation by increasing a suction amount of ink as compared with the case where the time is short.

When the liquid is ejected from the discharge unit, air bubbles contained in the liquid can be ejected together with the liquid. The ease of growth of air bubbles depends on an amount of liquid consumed. Specifically, the air bubbles are more likely to grow when the consumption amount of the liquid is small than when the consumption amount is large. Therefore, there is a risk that the air bubbles cannot be sufficiently ejected in the maintenance performed according to the time elapsed from the maintenance previously performed.

SUMMARY

A liquid discharge device for solving the above-described problems includes a discharge unit configured to discharge liquid, a maintenance unit configured to perform maintenance of the discharge unit by discharging liquid from the discharge unit, and a control unit configured to cause the maintenance unit to perform the maintenance periodically, wherein when performing the maintenance, the control unit performs first maintenance in a case in which a consumption amount of the liquid consumed after the maintenance previously performed is greater than or equal to a first threshold value, and performs second maintenance stronger than the first maintenance in a case in which the consumption amount is less than the first threshold value.

A liquid discharge device for solving the above-described problems includes a discharge unit configured to discharge liquid, a maintenance unit configured to perform maintenance of the discharge unit by discharging liquid from the discharge unit, and a control unit configured to cause the maintenance unit to perform the maintenance when an unused time, which is a time when the liquid discharge device is not used, exceeds a threshold time, wherein when performing the maintenance, the control unit performs first maintenance in a case in which a consumption amount of the liquid consumed during a predetermined period before the liquid discharge device is unused is greater than or equal to a first threshold value, and performs second maintenance stronger than the first maintenance in a case in which the consumption amount is less than the first threshold value.

A liquid discharge device for solving the above-described problems includes a discharge unit configured to discharge liquid, a maintenance unit configured to perform maintenance of the discharge unit by discharging liquid from the discharge unit, and a control unit configured to cause the maintenance unit to perform the maintenance, wherein when performing the maintenance in accordance with a user's instruction, the control unit performs third maintenance in a case in which a consumption amount of the liquid consumed during a predetermined period prior to the user's instruction is greater than or equal to a second threshold value, and performs fourth maintenance stronger than the third maintenance in a case in which the consumption amount is less than the second threshold value.

A maintenance method for a liquid discharge device for solving the above-described problems includes a maintenance method for a liquid discharge device including a discharge unit configured to discharge liquid, and a maintenance unit configured to cause the discharge unit to eject liquid to perform maintenance of the discharge unit, the method including, as the maintenance to be performed by the maintenance unit periodically, causing the the maintenance unit to perform first maintenance in a case in which a consumption amount of the liquid consumed after the maintenance previously performed is greater than or equal to a first threshold value, and causing the maintenance unit to perform second maintenance stronger than the first maintenance in a case in which the consumption amount is less than the first threshold value.

DESCRIPTION OF EXEMPLARY EMBODIMENTS

First Exemplary Embodiment

Figure 1:
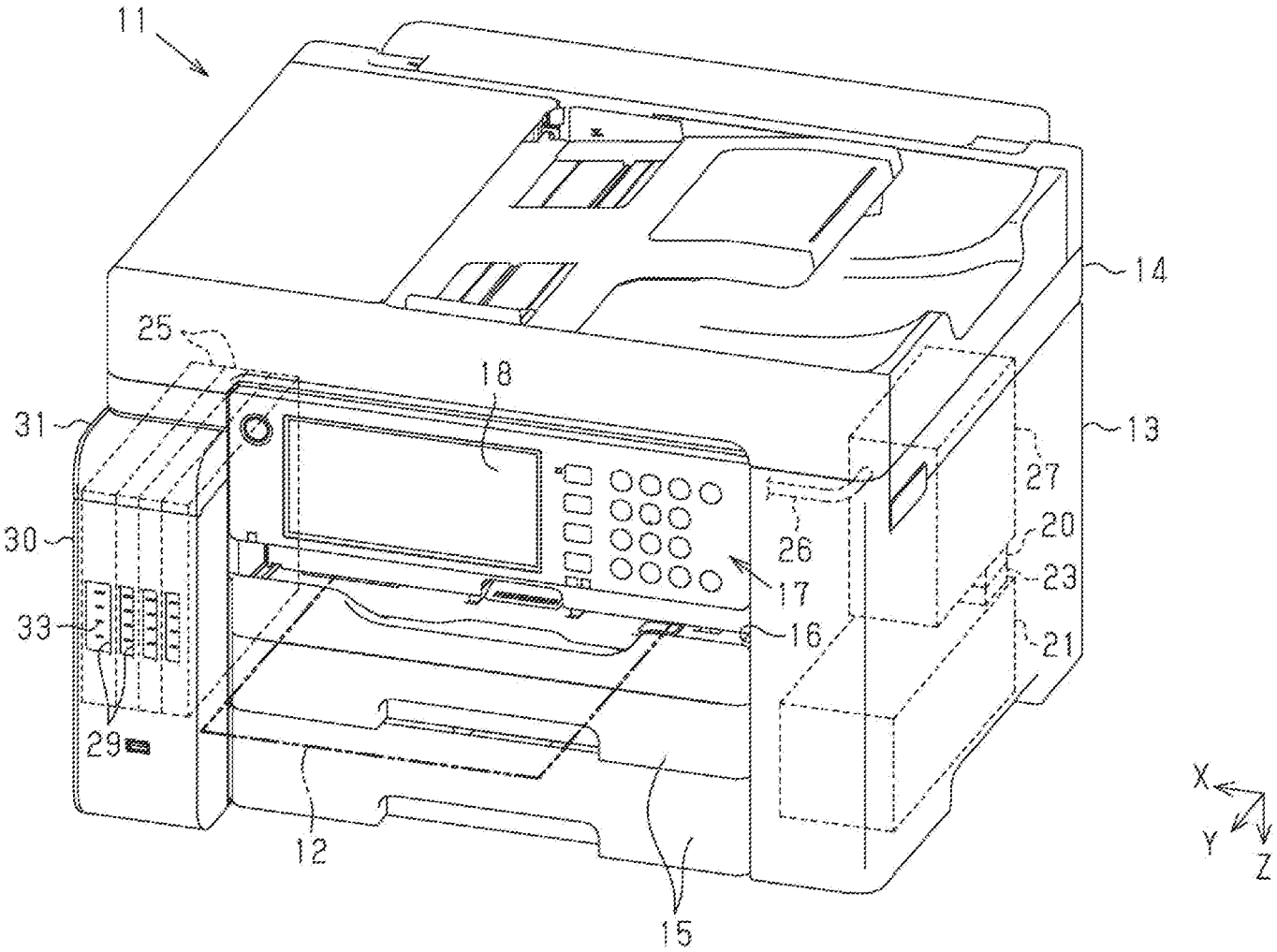
FIG. 1 is a perspective view of a first exemplary embodiment of a liquid discharge device.

Hereinafter, a first exemplary embodiment of a liquid discharge device and a maintenance method of the liquid discharge device will be described with reference to the drawings. The liquid discharge device is, for example, an inkjet printer that discharges ink, which is an example of liquid, to perform printing on a medium such as paper.

In the drawings, a direction of gravity is illustrated by a Z-axis, and directions along a horizontal plane are illustrated by an X-axis and a Y-axis, assuming that a liquid discharge device 11 is placed at the horizontal plane. The X-axis, Y-axis, and Z-axis are orthogonal to each other.

As illustrated in FIG. 1, the liquid discharge device 11 may include a printing unit 13 that performs printing on a medium 12 and a reading unit 14 that performs reading on an image of a document (not illustrated). The liquid discharge device 11 may include a medium accommodation unit 15 capable of accommodating a plurality of media 12, and an ejection unit 16 from which the printed medium 12 is ejected. The liquid discharge device 11 may include a setting input unit 17 that enables a user to input settings, and a display unit 18 that displays information. The setting input unit 17 of the present exemplary embodiment may be configured by a button, etc. for performing various operation of the liquid discharge device 11. The display unit 18 may be a touch panel, and the user may operate the touch panel to input settings.

The liquid discharge device 11 includes a discharge unit 20 that discharges liquid, and a maintenance unit 21 that ejects the liquid from the discharge unit 20 to perform maintenance of the discharge unit 20. The discharge unit 20 performs printing on the medium 12 by discharging the liquid onto the medium 12 from a nozzle (not illustrated).

The maintenance unit 21 of the present exemplary embodiment includes a cap 23. The cap 23 comes into contact with the discharge unit 20 to cap the discharge unit 20 to form a closed space surrounding the nozzle. The maintenance unit 21 of the present exemplary embodiment performs maintenance to eject the liquid from the nozzle by applying a negative pressure to the closed space formed by the cap 23. This maintenance is also called suction cleaning.

The liquid discharge device 11 may include a liquid accommodation body 25 that accommodates the liquid to be supplied to the discharge unit 20, a supply flow path 26 that couples the discharge unit 20 and the liquid accommodation body 25, and a carriage 27 that movably holds the discharge unit 20. The supply flow path 26 supplies the liquid from the liquid accommodation body 25 to the discharge unit 20. A portion of the supply flow path 26 may be configured by, for example, a tube that performs deformation by following the moving carriage 27.

The liquid discharge device 11 may include a housing 30 at which a window portion 29 for exposing a portion of the liquid accommodation body 25 to the outside is formed, and an accommodation cover 31 provided above the liquid accommodation body 25. The accommodation cover 31 is provided movably between a closed position illustrated in FIG. 1 and an open position illustrated in FIG. 2.

The liquid discharge device 11 may also include a plurality of liquid accommodation bodies 25 fixed in the housing 30. The housing 30 of the present exemplary embodiment accommodates four liquid accommodation bodies 25. Four window portions 29 are formed at the housing 30, individually corresponding to each liquid accommodation body 25. When the liquid accommodation body 25 is formed of a transparent or translucent resin, for example, a liquid level of the liquid to be accommodated can be seen from the window portion 29. A scale 33 may be provided at the liquid accommodation body 25 at a position exposed from the window portion 29.

When color printing is available using the liquid discharge device 11, the plurality of liquid accommodation bodies 25 each accommodate different types of liquid. For example, the four liquid accommodation bodies 25 accommodate liquid of the corresponding colors of black, cyan, magenta, and yellow, respectively.

Figure 2:
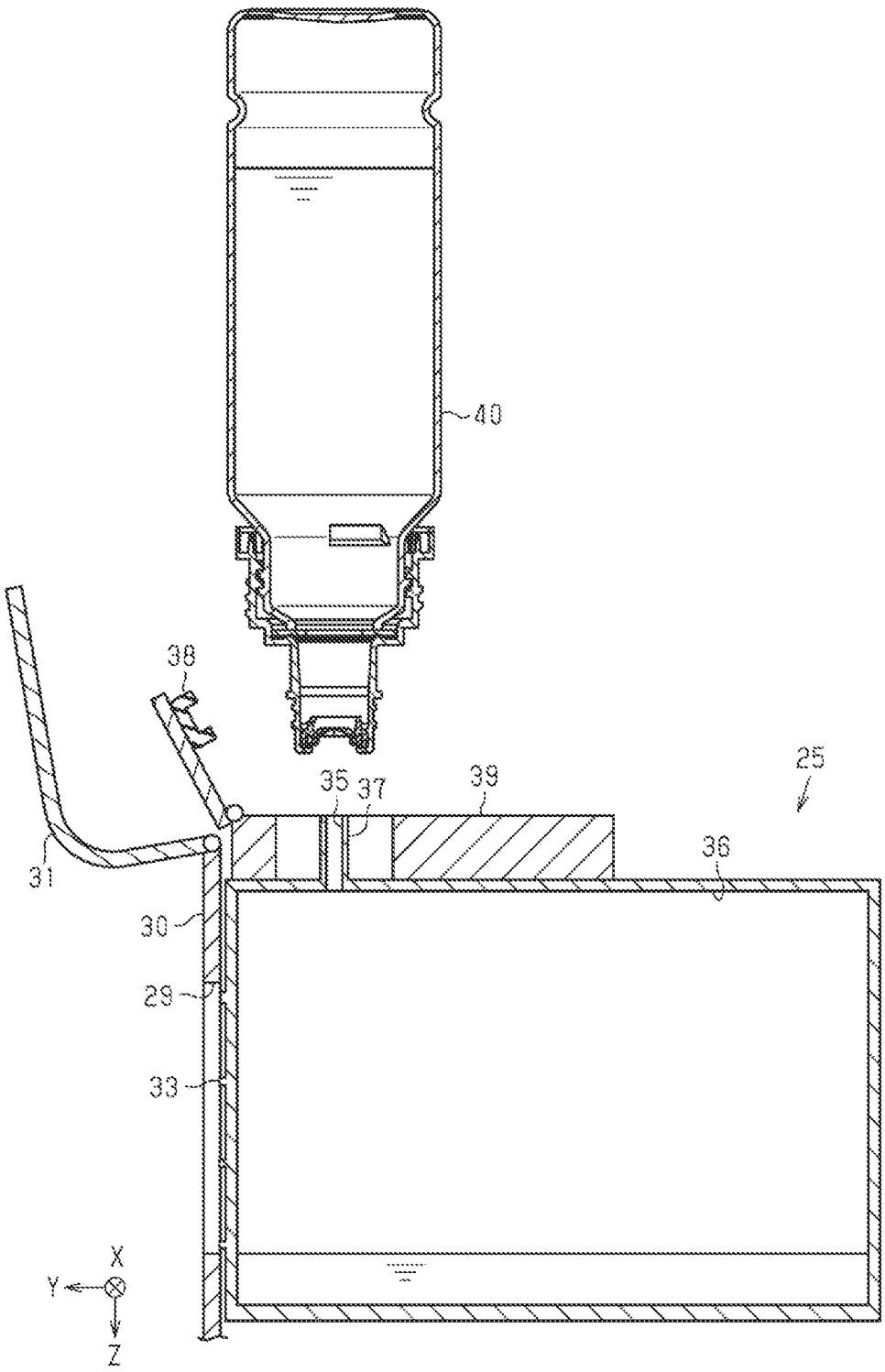
FIG. 2 is a schematic cross-sectional view of a liquid accommodation body included in the liquid discharge device.

As illustrated in FIG. 2, the liquid accommodation body 25 has an accommodation chamber 36 capable of accommodating the liquid injected from an injection port 35. The liquid accommodation body 25 may have a tubular unit 37 through which the injection port 35 is opened. The liquid discharge device 11 may include a plug 38 that closes the injection port 35 and a holding unit 39 that holds the plug 38. The plug 38 is provided movably between a closed position (not illustrated) at which the injection port 35 is closed and a replenishment position illustrated in FIG. 2 at which the injection port 35 is opened. The replenishment of the liquid accommodation body 25 with the liquid is performed by inserting a replenishment container 40 accommodating the replenishment liquid into the tubular unit 37 in a state where the accommodation cover 31 is in the open position and the plug 38 is in the replenishment position.

Control Unit

Figure 3:
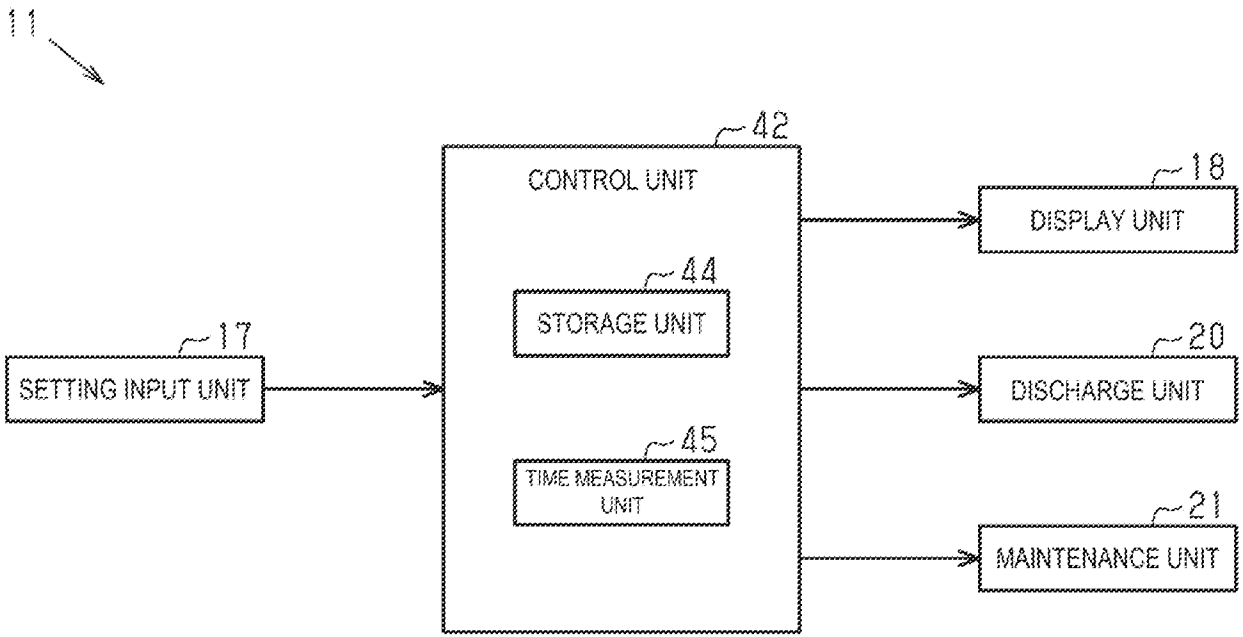
FIG. 3 is a block diagram of the liquid discharge device.

As illustrated in FIG. 3, the liquid discharge device 11 includes a control unit 42. The control unit 42 comprehensively controls the driving of each mechanism in the liquid discharge device 11, and controls various operation performed by the liquid discharge device 11.

The control unit 42 may be configured as a circuit including α: one or more processors for performing various processes according to a computer program, β: one or more dedicated hardware circuits such as application-specific integrated circuits that perform at least some processing of various processes, or γ: combinations thereof. The processor includes a CPU and a memory such as a RAM and a ROM, and the memory stores a program code or an instruction configured to cause the CPU to execute a process. The memory, i.e. a computer-readable medium, includes any readable medium that can be accessed by a general-purpose or dedicated computer.

The control unit 42 may have a storage unit 44 and a time measurement unit 45. The control unit 42 may cause the memory to function as the storage unit 44, or may include the storage unit 44 apart from the memory. The time measurement unit 45 measures a time.

The control unit 42 causes the maintenance unit 21 to perform maintenance periodically. Specifically, the control unit 42 causes periodic maintenance to be performed when a certain period of time has elapsed since the previous maintenance. This certain period of time is a fixed value stored in the storage unit 44 in advance such as 100 days, 180 days, and half a year, and may be renewable.

The control unit 42 may perform suction cleaning or flushing as normal maintenance in addition to the periodic maintenance. The control unit 42 may perform the normal maintenance during the power source is on, during the power source is off, during printing is performed, etc. The suction cleaning performed in the normal maintenance may be weaker than the suction cleaning performed in the periodic maintenance. The flushing is, for example, maintenance in which the liquid is discharged from the nozzle to the cap 23.

Figure 4:
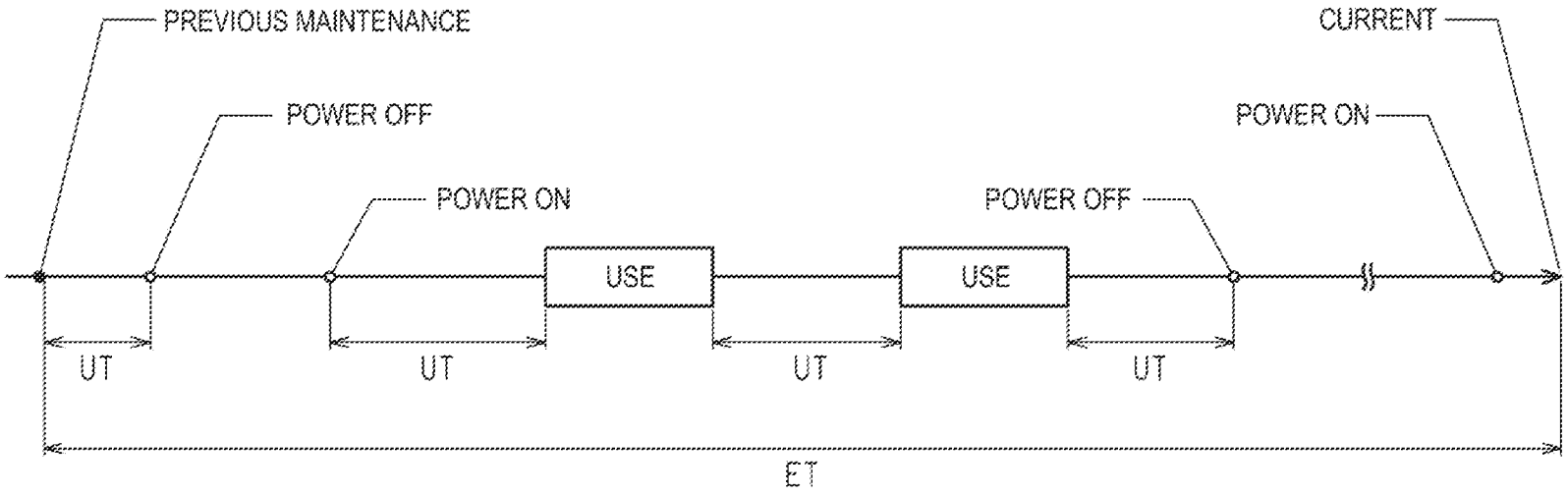
FIG. 4 is an explanatory diagram illustrating a usage state of the liquid discharge device.

As illustrated in FIG. 4, the control unit 42 may store, in the storage unit 44 as timing information, a date or date/time when the control unit 42 causes the maintenance unit 21 to perform the periodic maintenance. The control unit 42 may compare the current date or date/time with timing information stored in the storage unit 44 to calculate an elapsed time ET that has elapsed since the previous maintenance. The control unit 42 may determine that the periodic maintenance is necessary when the elapsed time ET exceeds a certain period of time stored in the storage unit 44.

The control unit 42 may store, in the storage unit 44, a time zone UT during which the power source is on and is not in use. The time zone UT is, for example, a time zone during which printing is not performed, and is a time zone during which the cap 23 is capping the discharge unit 20.

For example, when the power source is turned off after being used a plurality of times after the power source is turned on, the time zone UT corresponds to a time from when the power source is turned on until the start of use, a time from the end of the previous use to the start of the next use, and a time from the end of use until the power source is turned off. For example, when the power source is turned off without being used after the power source is turned on, the time from when the power source is turned on to the present time corresponds to the time zone UT.

The control unit 42 may set an execution time zone based on the time zone UT stored in the storage unit 44, and may store this execution time zone in the storage unit 44. The storage unit 44 of the present exemplary embodiment can store the time zone UT of a plurality of days. That is, the storage unit 44 may store the time zone UT in association with the date. The control unit 42 may set the time zone UT that happened a greatest number of times as the execution time zone, among the time zones in a plurality of days.

The user may operate the setting input unit 17 to set a time to perform maintenance. In the following description, the time set by the setting input unit 17 is also referred to as a set time. The storage unit 44 stores the set time.

Next, a maintenance routine performed by the control unit 42 will be described with reference to a flowchart illustrated in FIG. 5 The control unit 42 performs the maintenance routine at a timing when the power source of the liquid discharge device 11 is turned on.

Figure 5:
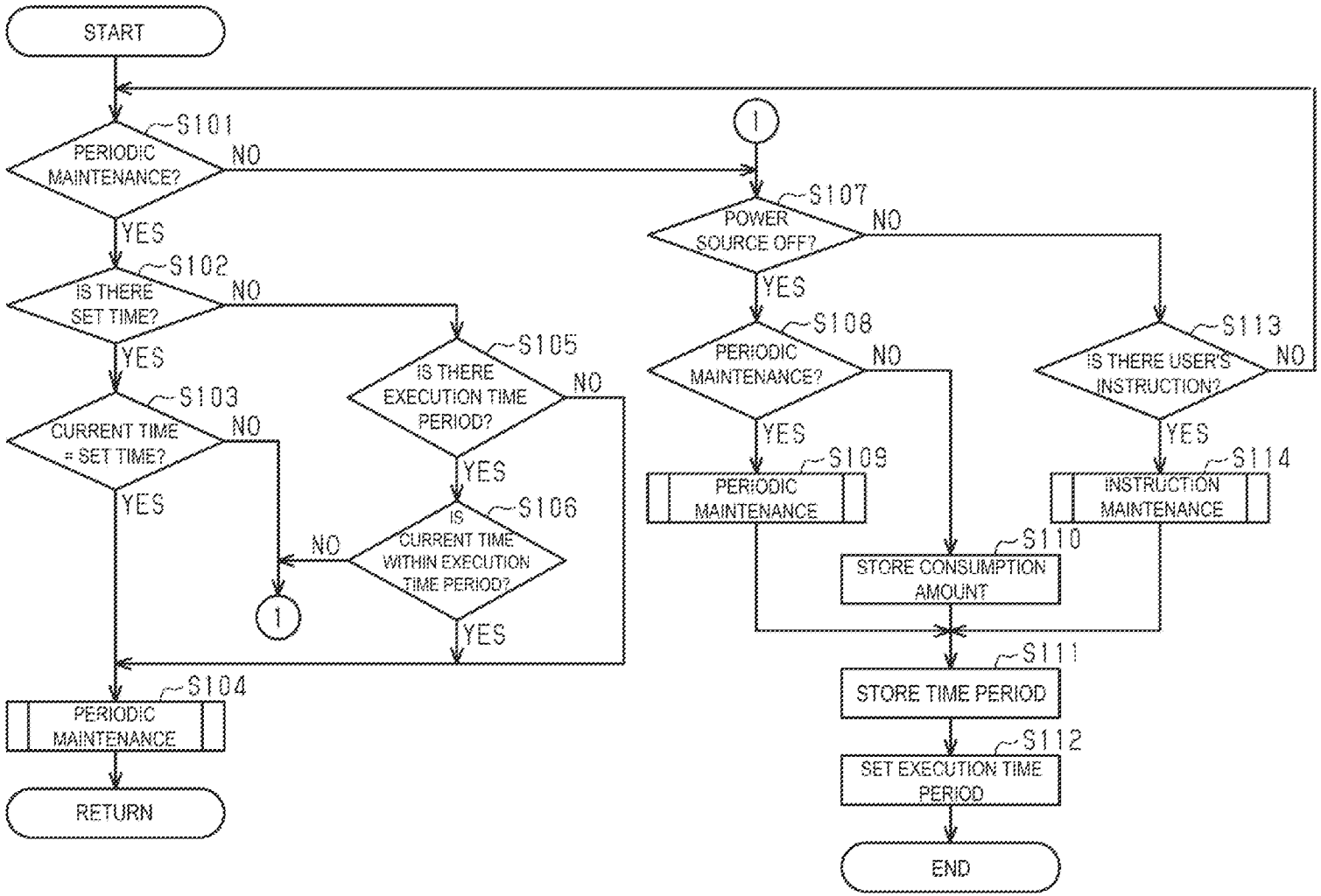
FIG. 5 is a flowchart illustrating a maintenance routine.

As illustrated in FIG. 5, in step S101, the control unit 42 determines the necessity of the periodic maintenance. That is, the control unit 42 determines that periodic maintenance is necessary when the elapsed time ET exceeds a certain period of time, and determines that the periodic maintenance is not necessary when the elapsed time ET does not exceed a certain period of time. When the periodic maintenance is required, step S101 is determined to be YES, and the control unit 42 transitions the process to step S102.

In step S102, the control unit 42 determines whether the storage unit 44 stores the set time set by the setting input unit 17. When the set time is stored, step S102 is determined to be YES, and the control unit 42 transitions the process to step S103.

In step S103, the control unit 42 determines whether the current time and the set time are equal. In step S103, when the current time is not the set time, step S103 is determined to be NO, and the control unit 42 transitions the process to step S107. When the current time is the set time, step S103 is determined to be YES, and the control unit 42 transitions the process to step S104 and performs the periodic maintenance routine illustrated in FIG. 6. That is, the control unit 42 performs the periodic maintenance routine at the set time.

When the storage unit 44 does not store the set time in step S102, step S102 is determined to be NO, and the control unit 42 transitions the process to step S105. In step S105, the control unit 42 determines whether the storage unit 44 stores the execution time zone. When the execution time zone is stored, step S105 is determined to be YES, and the control unit 42 transitions the process to step S106.

In step S106, the control unit 42 determines whether the current time is included in the execution time zone. In step S106, when the current time is not included in the execution time zone, step S106 is determined to be NO, and the control unit 42 transitions the process to step S107. When the current time is included in the execution time zone, step S106 is determined to be YES, and the control unit 42 transitions the process to step S104 and performs the periodic maintenance routine illustrated in FIG. 6. That is, the control unit 42 performs the periodic maintenance routine at the execution time zone. The control unit 42 performs the periodic maintenance routine in step S104, and then transitions the process to step S101.

When the periodic maintenance is not required in step S101, step S101 is determined to be NO, and the control unit 42 transitions the process to step S107. In step S107, the control unit 42 determines whether an instruction to turn off the power source of the liquid discharge device 11 has been input. When the power source is turned off, step S107 is determined to be YES, and the control unit 42 transitions the process to step S108.

In step S108, the control unit 42 determines the necessity of periodic maintenance as in step S101. When the periodic maintenance is required, step S108 is determined to be YES, and the control unit 42 transitions the process to step S109. In step S109, the control unit 42 performs the periodic maintenance routine illustrated in FIG. 6 in the same manner as in step S104, and transitions the process to step S111.

When the periodic maintenance is not required in step S108, step S108 is determined to be NO, and the control unit 42 transitions the process to step S110. In step S110, the control unit 42 stores a consumption amount in the storage unit 44. The consumption amount is a total amount of an amount of liquid discharged from the discharge unit 20 onto the medium 12 for printing and an amount of liquid ejected from the discharge unit 20 for the normal maintenance. The control unit 42 adds the amount of liquid consumed from the time when the power source is turned on to the present time and the consumption amount stored in the storage unit 44, and then updates the consumption amount stored in the storage unit 44 to the calculated consumption amount.

In step S111, the control unit 42 stores, in the storage unit 44, the time zone UT during which the power source is not in use since the power source is turned on. In step S112, the control unit 42 sets the execution time zone based on the time zone UT stored in the storage unit 44, and ends the maintenance routine.

When the power source is not turned off in step S107, step S107 is determined to be NO, and the control unit 42 transitions the process to step S113. In step S113, it is determined whether the user has instructed to perform maintenance. When the execution of the maintenance is not instructed, step S113 is determined to be NO, and the control unit 42 transitions the process to step S101. When the execution of the maintenance is instructed, step S113 is determined to be YES, and the control unit 42 transitions the process to step S114. In step S114, the control unit 42 performs an instruction maintenance routine illustrated in FIG. 7, and transitions the process to step S111.

Next, the periodic maintenance routine performed by the control unit 42 in steps S104 and S109 will be described with reference to a flowchart illustrated in FIG. 6.

Figure 6:
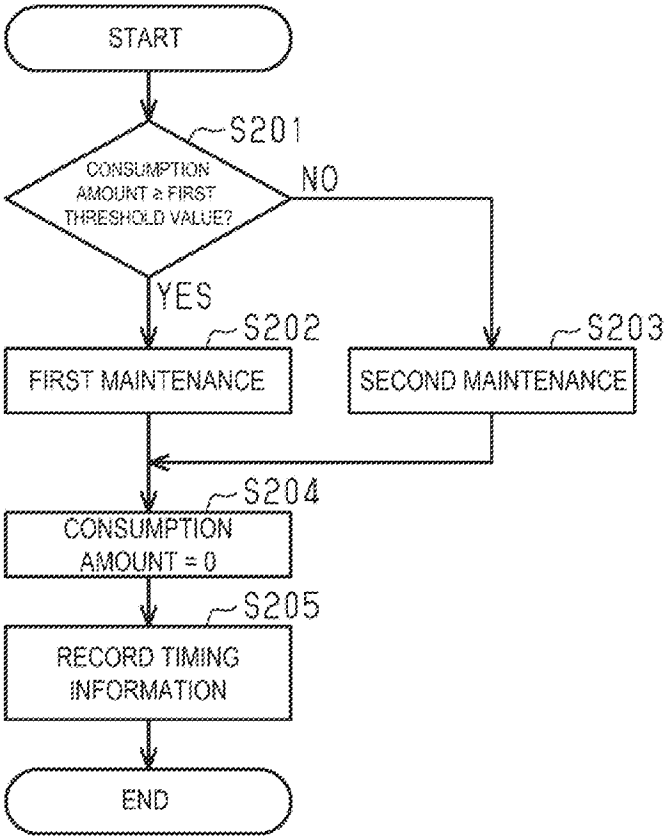
FIG. 6 is a flowchart illustrating a periodic maintenance routine.

As illustrated in FIG. 6, in step S201, the control unit 42 compares the consumption amount stored in the storage unit 44 with a first threshold value stored in the storage unit 44.

In step S201, when the consumption amount is greater than or equal to the first threshold value, step S201 is determined to be YES, and the control unit 42 transitions the process to step S202. In step S202, the control unit 42 causes the maintenance unit 21 to perform first maintenance.

In step S201, when the consumption amount is less than the first threshold value, step S201 is determined to be NO, and the control unit 42 transitions the process to step S203. In step S203, the control unit 42 causes the maintenance unit 21 to perform second maintenance.

In step S204, the control unit 42 resets the consumption amount stored in the storage unit 44. In step S205, the control unit 42 stores timing information such as the current date or date/time in the storage unit 44.

Next, the instruction maintenance routine performed by the control unit 42 in step S114 will be described with reference to a flowchart illustrated in FIG. 7.

Figure 7:
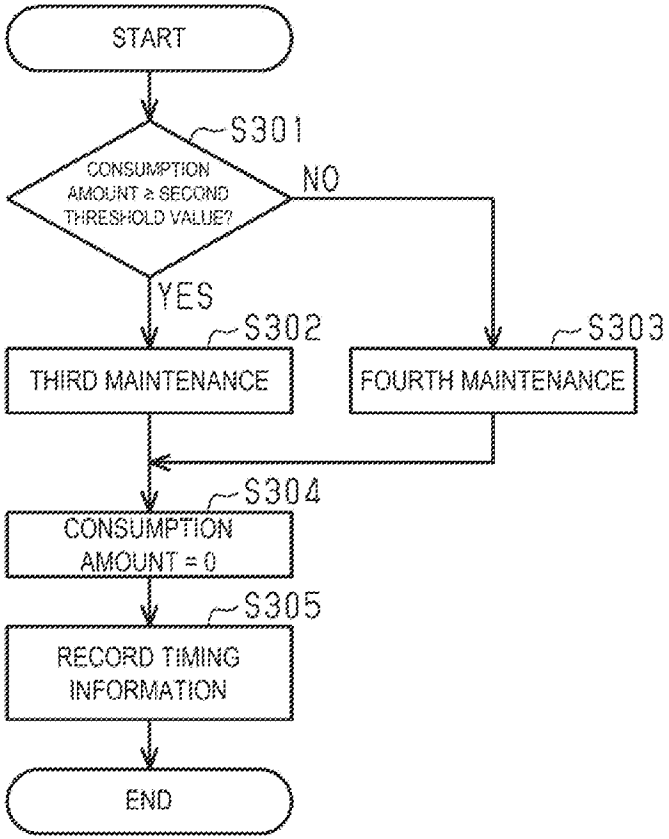
FIG. 7 is a flowchart illustrating an instruction maintenance routine.

As illustrated in FIG. 7, in step S301, the control unit 42 compares the consumption amount stored in the storage unit 44 with a second threshold value stored in the storage unit 44. The second threshold value of the present exemplary embodiment is a value smaller than the first threshold value.

In step S301, when the consumption amount is greater than or equal to the second threshold value, step S301 is determined to be YES, and the control unit 42 transitions the process to step S302. In step S302, the control unit 42 causes the maintenance unit 21 to perform third maintenance.

In step S301, when the consumption amount is less than the second threshold value, step S301 is determined to be NO, and the control unit 42 transitions the process to step S303. In step S303, the control unit 42 causes the maintenance unit 21 to perform fourth maintenance.

In step S304, the control unit 42 resets the consumption amount stored in the storage unit 44. In step S305, the control unit 42 stores timing information such as the current date or date/time in the storage unit 44.

Next, actions of the present exemplary embodiment will be described.

The maintenance unit 21 of the present exemplary embodiment causes the suction cleaning to be performed as the first maintenance to the fourth maintenance. The consumption amount stored in the storage unit 44 is reset every time the maintenance unit 21 performs any of the first maintenance to the fourth maintenance. Therefore, the consumption amount stored in the storage unit 44 is the amount of liquid consumed by the liquid discharge device 11 since the previous maintenance.

When performing the maintenance, the control unit 42 causes the first maintenance to be performed in a case in which the consumption amount of the liquid consumed after the previous maintenance is greater than or equal to the first threshold value, and causes the second maintenance stronger than the first maintenance to be performed in a case in which the consumption amount is less than the first threshold value.

The strong maintenance is maintenance that has a strong action of ejecting air bubbles together with the liquid. For example, in the second maintenance, the negative pressure acting on the discharge unit 20 may be greater than that in the first maintenance. In the second maintenance, the amount of liquid to be ejected may be greater than that in the first maintenance. In the second maintenance, the liquid may be ejected more vigorously than in the first maintenance. In the second maintenance, the time for ejecting the liquid may be longer than that in the first maintenance.

The control unit 42 may cause the first maintenance or the second maintenance to be performed in any time zone UT among the time zones UT stored in the storage unit 44. The control unit 42 of the present exemplary embodiment causes the first maintenance or the second maintenance to be performed in the time zone UT set as the execution time zone among the time zones UT stored in the storage unit 44.

When instructed to perform maintenance by the user, the control unit 42 may cause the third maintenance or the fourth maintenance to be performed. Specifically, when performing the maintenance in accordance with the user's instruction, the control unit 42 causes the third maintenance to be performed in a case in which the consumption amount of the liquid consumed during the predetermined period prior to the user's instruction is greater than or equal to the second threshold value. The control unit 42 may causes the fourth maintenance stronger than the third maintenance to be performed when the consumption amount of the liquid consumed during the predetermined period prior to the user's instruction is less than the second threshold value.

In the present exemplary embodiment, the predetermined period prior to the user's instruction corresponds to a period from the execution of the previous maintenance to the user's instruction. The predetermined period is a period shorter than a certain period of time stored by the storage unit 44.

Effects of the present exemplary embodiment will now be described.

(1) The control unit 42 causes the first maintenance or the second maintenance to be performed based on the consumption amount since the previous maintenance. Therefore, the maintenance can be performed in consideration of the growth of air bubbles, whereby the reliability of the maintenance can be improved.

(2) Since the liquid discharge device 11 includes the setting input unit 17, the liquid discharge device 11 can be set to perform maintenance at a time desired by the user.

(3) The storage unit 44 stores the time zone UT during which the power source is on and is not in use. The control unit 42 performs the maintenance in any time zone UT among the time zones UT stored in the storage unit 44, whereby it is possible to reduce a risk that the maintenance will be performed when the user uses the liquid discharge device 11.

(4) The storage unit 44 can store the time zone UT during which the power source is on and is not in use or a plurality of days. Among the time zones UT of the plurality of days, the control unit 42 performs the maintenance in the time zone UT that happened a greatest number of times. Therefore, it is possible to further reduce a risk that the maintenance will be performed when the user uses the liquid discharge device 11.

(5) The control unit 42 causes the third maintenance or the fourth maintenance to be performed based on the consumption amount during the predetermined period prior to the user's instruction. Therefore, the maintenance can be performed in consideration of the growth of air bubbles, whereby the reliability of the maintenance can be further improved.

(6) The liquid accommodation body 25 accommodates the liquid injected from the injection port 35. Since the liquid injected from the injection port 35 comes into contact with the atmosphere at the time of injection, the air bubbles are likely to grow. As described above, even when liquid in which air bubbles easily grow is used, the risk that the reliability of maintenance is lowered can be reduced.

(7) The supply flow path 26 configured by a tube is more likely to allow gas to permeate than a flow path configured by for example, a highly rigid member. The permeated gas may appear as air bubbles in the liquid. In that respect, the control unit 42 causes the maintenance unit 21 to perform maintenance in consideration of the ease of growth of the air bubbles. Therefore, the maintenance of the discharge unit 20 can be properly performed.

Second Exemplary Embodiment

Next, a second exemplary embodiment of the liquid discharge device and the maintenance method of the liquid discharge device will be described with reference to the drawings.

Figure 8:
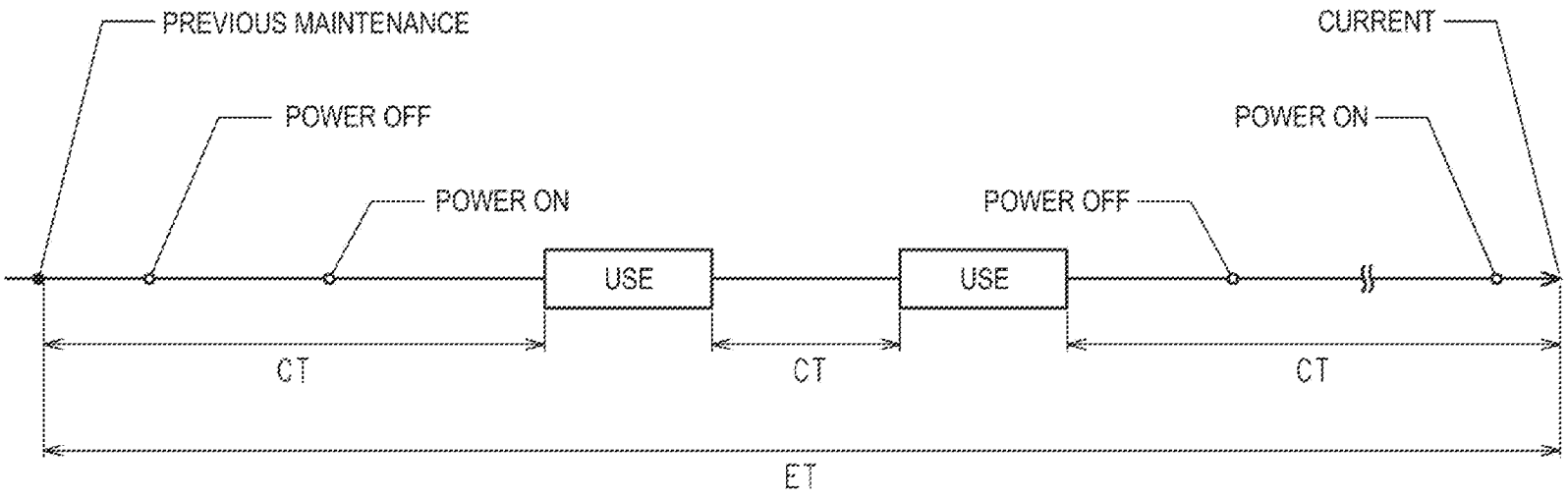
FIG. 8 is an explanatory diagram illustrating a usage state of a liquid discharge device according to a second exemplary embodiment.

The flow of processing executed by the control unit 42 in the second exemplary embodiment is the same as the flowcharts illustrated in FIGS. 5 to 7 of the first exemplary embodiment. In the second exemplary embodiment, in step S101 and step S108 illustrated in FIG. 5, the method of determining whether the periodic maintenance is necessary is different from that of the first exemplary embodiment. That is, in this second exemplary embodiment, a timing at which the control unit 42 causes the periodic maintenance to be performed is different from the case of the first exemplary embodiment. Further, since other features are substantially the same as those of the first exemplary embodiment, duplicate explanations will be omitted by assigning the same reference numerals to the same configurations, As illustrated in FIG. 8, the control unit 42 determines that the maintenance is necessary when an unused time exceeds a threshold time. This unused time is, among the time from the previous maintenance to the present time, a time while the power source is not used regardless of whether the power source is on or off. That is, the unused time is a total time of a capping time CT during which the cap 23 is capping the discharge unit 20. The unused time is equal to the elapsed time ET minus the used time. The threshold time is a fixed value stored in the storage unit 44 in advance, such as 2,000 hours, 3,000 hours, and 4,000 hours, and may be updatable.

Next, actions of the present exemplary embodiment will be described.

When performing the maintenance, the control unit 42 causes the first maintenance to be performed when the consumption amount of the liquid consumed during a predetermined period before the liquid discharge device is unused is greater than or equal to the first threshold value. When the consumption amount is less than the first threshold value, the control unit 42 causes the second maintenance, which is stronger than the first maintenance, to be performed.

In the present exemplary embodiment, the predetermined period before the liquid discharge device is unused is a period from the execution of the previous maintenance to the end of the latest use. Therefore, the consumption amount of liquid consumed during the predetermined period before the liquid discharge device is unused is equal to the consumption amount of liquid consumed after the previous maintenance. The control unit 42 causes the periodic maintenance to be performed as in the first exemplary embodiment.

Effects of the present exemplary embodiment will now be described.

(8) The control unit 42 causes the first maintenance or the second maintenance to be performed based on the consumption amount during the predetermined period before the liquid discharge device is unused. Therefore, the maintenance can be performed in consideration of the growth of air bubbles, whereby the reliability of the maintenance can be improved.

The present exemplary embodiment described above may be modified as follows. The present exemplary embodiment and modified examples thereof to be described below may be implemented in combination within a range in which a technical contradiction does not arise.

The maintenance unit may perform pressure cleaning to eject the pressurized liquid from the nozzle as maintenance. That is, the maintenance unit may include a pressurizing mechanism that pressurizes the liquid in the discharge unit 20, and a receiving unit that receives the ejected liquid. The control unit 42 may perform weak pressure cleaning as the first maintenance and the third maintenance, and perform strong pressure cleaning as the second maintenance and the fourth maintenance. For example, in the strong pressure cleaning, the pressing force acting on the discharge unit 20 may be greater than that in the weak pressure cleaning.

The maintenance unit may perform flushing as maintenance. The maintenance unit may include the receiving unit that receives the liquid discharged from the discharge unit 20 separately from the cap 23. The control unit 42 may perform weak flushing as the first maintenance and the third maintenance, and strong flushing as the second maintenance and the fourth maintenance. For example, the strong flushing may result in more droplets being discharged than the weak flushing. The strong flushing may result in the size of the droplets being discharged greater than the weak flushing. The strong flushing may result in more droplets being discharged per unit time than the weak flushing.

The maintenance unit may perform choke cleaning to eject the liquid after accumulating the negative pressure as maintenance. The maintenance unit may include a valve that limits the supply of the liquid to the discharge unit 20. The maintenance unit may accumulate the negative pressure by closing the valve when the closed space formed by the cap 23 is made negative pressure. The maintenance unit may vigorously eject the liquid from the discharge unit 20 by opening the valve after accumulating the negative pressure. The chalk cleaning is stronger maintenance than the suction cleaning. The maintenance unit may change the strength of choke cleaning by changing a magnitude of the negative pressure accumulated in the closed space in a state where the valve is closed. The control unit 42 may perform weak choke cleaning as the first maintenance and the third maintenance, and strong choke cleaning as the second maintenance and the fourth maintenance. For example, the strong choke cleaning may allow a time to accumulate the negative pressure in the valve closed state to be longer than that of the weak choke cleaning.

The third maintenance may be the same as the first maintenance. The fourth maintenance is the same as the second maintenance.

The control unit 42 may cause different types of maintenance to be performed as the first maintenance to the fourth maintenance. For example, the control unit 42 may perform the suction cleaning as the first maintenance and the third maintenance, and the choke cleaning as the second maintenance and the fourth maintenance. For example, the control unit 42 may perform the pressure cleaning as the first maintenance and the third maintenance, and the suction cleaning as the second maintenance and the fourth maintenance. For example, the control unit 42 may perform the suction cleaning as the first maintenance, the choke cleaning as the second maintenance, the flushing as the third maintenance, and the pressure cleaning as the fourth maintenance.

The user may operate the setting input unit 17 to set a time zone for performing maintenance. In this case, the control unit 42 may perform the periodic maintenance routine when the current time is included in the set time zone.

The control unit 42 may measure the elapsed time ET that has elapsed since the previous maintenance has been executed. The control unit 42 may perform the periodic maintenance routine when the measured elapsed time ET exceeds a certain period of time stored in the storage unit 44.

The liquid accommodation body 25 may be a cartridge that is detachably attached to the liquid discharge device 11.

The liquid discharge device 11 may be an on-carriage type device in which the liquid accommodation body 25 is provided at the carriage 27. That is, the liquid accommodation body 25 may move together with the carriage 27.

The first threshold value of the first exemplary embodiment and the first threshold value of the second exemplary embodiment may have the same value or different values.

The second threshold value may be the same value as the first threshold value or may be a different value. The second threshold value may be changed according to the length of the predetermined period prior to the user's instruction. For example, the second threshold value may be a value obtained by multiplying the first threshold value by a ratio of the predetermined period prior to the user's instruction to a certain period of time to perform the periodic maintenance. The predetermined period prior to the user's instruction may be a period from the time when the power source is turned off after the previous maintenance is performed to the user's instruction. The predetermined period prior to the user's instruction may be a period from the end of the previous printing to the user's instruction. The predetermined period prior to the user's instruction may be a preset fixed period.

The control unit 42 does not need to set the execution time zone. The control unit 42 may cause the maintenance to be performed in any time zone UT among the time zones UT stored in the storage unit 44. For example, the control unit 42 may perform the periodic maintenance routine when the current time is included in the stored time zone UT.

The control unit 42 may delete, from the storage unit 44, the time zone UT during which a certain time has elapsed since the storage is stored. For example, the control unit 42 may delete, from the storage unit 44, the time zone UT during which 24 hours have elapsed since the storage is stored. That is, the storage unit 44 may store the time zone UT for one day.

The storage unit 44 does not need to store the time zone UT.

The liquid discharge device 11 may be configured not to include the setting input unit 17.

The control unit 42 may determine whether the periodic maintenance is required for at least one arbitrary timing, such as when the power source is turned on, when the power source is instructed to be turned off, or when printing is completed. The control unit 42 may perform the periodic maintenance routine at the timing when it is determined that the periodic maintenance is necessary.

The storage unit 44 may store a time zone during which the liquid discharge device 11 was used. The storage unit 44 may store a time zone during which the capping is not performed. The control unit 42 may perform the periodic maintenance routine when the current time is not included in the time zone to be stored.

The liquid discharge device 11 may include a communication unit that communicates with an external terminal having a setting input unit. The communication unit may be capable of communicating with the external terminal by wire, wireless, a connector, etc. The user may input a time to perform maintenance using the external terminal. The user may instruct the execution of maintenance using the external terminal.

In the second exemplary embodiment, the unused time compared with the threshold time may be a time while the power source is off.

The discharge unit 20 may be configured as a serial type that performs scanning with respect to the medium 12, or may be configured as a line type where the discharge unit 20 is provided in a long length in a width direction of the medium 12.

The liquid discharge device 11 may be a liquid discharge device that sprays or discharges liquid other than ink. The state of the liquid discharged as a minute amount of droplets from the liquid discharge device shall include those having a granular, tear-like, or thread-like state. The liquid referred to here may be any material that can be discharged from the liquid discharge device. For example, the liquid may be in a state where the substance is in the liquid phase, and shall include fluids such as highly viscous or low viscous liquid, sol, gel water, other inorganic solvents, organic solvents, solutions, liquid resins, liquid metals, metal melts, etc. The liquid shall include not only liquid as a state of a substance but also liquid where particles of a functional material made of a solid substance such as a pigment or a metal particle are dissolved, dispersed or mixed in a solvent. Typical examples of the liquid include ink, liquid crystal, etc. as described in the above-described exemplary embodiment. Here, the ink shall include general water-based ink, oil-based ink, and various liquid compositions such as gel ink and hot melt ink. A specific example of the liquid discharge device includes, for example, a device that discharges liquid containing materials such as electrode materials and color materials used in the manufacture of liquid crystal displays, electroluminescence displays, surface emitting displays, color filters, etc. in the form of dispersion or dissolution. The liquid discharge device may be a device for discharging a bioorganic substance used for producing a biochip, a device for discharging a liquid as a sample used as a precision pipette, a printing device, a micro dispenser, etc. The liquid discharge device may be a device that pinpointly discharges lubricating oil to precision machinery such as watches and cameras, and a device that discharges transparent resin liquid such as an ultraviolet curable resin onto a substrate to form a microhemispherical lens, an optical lens, etc. used for an optical communication element, etc. The liquid discharge device may be a device that discharges etching solution such as an acid or an alkali in order to etch a substrate, etc.

Hereinafter, technical concepts and effects thereof that are understood from the above-described exemplary embodiments and modified examples will be described.

(A) A liquid discharge device includes a discharge unit configured to discharge liquid, a maintenance unit configured to perform maintenance of the discharge unit by discharging liquid from the discharge unit, and a control unit configured to cause the maintenance unit to perform the maintenance periodically, wherein when performing the maintenance, the control unit performs first maintenance in a case in which a consumption amount of the liquid consumed after the previous maintenance is greater than or equal to a first threshold value, and performs second maintenance stronger than the first maintenance in a case in which the consumption amount is less than the first threshold value.

According to this configuration, the control unit causes the first maintenance or the second maintenance to be performed based on the consumption amount since the previous maintenance. Therefore, the maintenance can be performed in consideration of the growth of air bubbles, whereby the reliability of the maintenance can be improved.

(B) A liquid discharge device includes a discharge unit configured to discharge liquid, a maintenance unit configured to perform maintenance of the discharge unit by discharging liquid from the discharge unit, and a control unit configured to cause the maintenance unit to perform the maintenance when an unused time, which is a time when the liquid discharge device is not used, exceeds a threshold time, wherein when performing the maintenance, the control unit performs first maintenance in a case in which a consumption amount of the liquid consumed during a predetermined period before the liquid discharge device is unused is greater than or equal to a first threshold value, and performs second maintenance stronger than the first maintenance in a case in which the consumption amount is less than the first threshold value.

According to this configuration, the control unit causes the first maintenance or the second maintenance to be performed based on the consumption amount during the predetermined period before the liquid discharge device is unused. Therefore, the maintenance can be performed in consideration of the growth of air bubbles, whereby the reliability of the maintenance can be improved.

(C) The liquid discharge device may include a setting input unit for a user to set a time to perform the maintenance.

According to this configuration, since the liquid discharge device includes the setting input unit, the liquid discharge device can be set to perform maintenance at a time desired by the user.

(D) In the liquid discharge device, the control unit may include a storage unit configured to store time zones during which a power source is on and is not in use, and the control unit may cause the maintenance to be performed in any time zone among the time zones stored in the storage unit.

According to this configuration, the storage unit stores the time zone during which the power source is on and is not in use. The control unit performs the maintenance in any time zone among the time zones stored in the storage unit, whereby it is possible to reduce a risk that the maintenance will be performed when the user uses the liquid discharge device.

(E) In the liquid discharge device, the storage unit may be configured to store the time zones in a plurality of days, and the control unit may be configured to perform the maintenance in a time zone that happened a greatest number of times among the time zones in a plurality of days.

According to this configuration, the storage unit can store the time zone during which the power source is on and is not in use or a plurality of days. Among the time zones in the plurality of days, the control unit performs the maintenance in the time zone that happened a greatest number of times. Therefore, it is possible to further reduce a risk that the maintenance will be performed when the user uses the liquid discharge device.

(F) In the liquid discharge device, when performing the maintenance in accordance with a user's instruction, the control unit may cause third maintenance to be performed in a case in which a consumption amount of the liquid consumed during a predetermined period prior to the user's instruction is greater than or equal to a second threshold value, and may cause fourth maintenance stronger than the third maintenance to be performed in a case in which a consumption amount of the liquid consumed during a predetermined period prior to the user's instruction is less than the second threshold value.

According to this configuration, the control unit causes the third maintenance or the fourth maintenance to be performed based on the consumption amount during the predetermined period prior to the user's instruction. Therefore, the maintenance can be performed in consideration of the growth of air bubbles, whereby the reliability of the maintenance can be further improved.

(G) A liquid discharge device includes a discharge unit configured to discharge liquid, a maintenance unit configured by discharging liquid from the discharge unit to perform maintenance of the discharge unit, and a control unit configured to cause the maintenance unit to perform the maintenance, wherein when performing the maintenance in accordance with a user's instruction, the control unit performs third maintenance in a case in which a consumption amount of the liquid consumed during a predetermined period prior to the user's instruction is greater than or equal to a second threshold value, and performs fourth maintenance stronger than the third maintenance in a case in which the consumption amount is less than the second threshold value. According to this configuration, the same effect as that of the liquid discharge device can be obtained.

(H) The liquid discharge device may include a liquid accommodation body including an accommodation chamber configured to accommodate the liquid injected from an injection port, and a supply flow path configured to couple the discharge unit and the liquid accommodation body, According to this configuration, the liquid accommodation body accommodates the liquid injected from the injection port. Since the liquid injected from the injection port comes into contact with the atmosphere at the time of injection, the air bubbles are likely to grow. As described above, even when liquid in which air bubbles easily grow is used, the risk that the reliability of maintenance is lowered can be reduced.

(I) A maintenance method for a liquid discharge device includes a maintenance method for a liquid discharge device including a discharge unit configured to discharge liquid, and a maintenance unit configured to cause the discharge unit to eject liquid to perform maintenance of the discharge unit, the method including, as the maintenance to be performed by the maintenance unit periodically, causing first maintenance to be performed in a case in which a consumption amount of the liquid consumed after the previous maintenance is greater than or equal to a first threshold value, and causing second maintenance stronger than the first maintenance to be performed in a case in which the consumption amount is less than the first threshold value. According to this configuration, the same effect as that of the liquid discharge device can be obtained.

What is claimed is:

1. A liquid discharge device, comprising:

a discharge unit configured to discharge liquid;

a maintenance unit configured to perform maintenance of the discharge unit by discharging liquid from the discharge unit; and a control unit configured to cause the maintenance unit to perform the maintenance periodically, wherein when performing the maintenance, the control unit performs first maintenance in a case in which a consumption amount of the liquid consumed after the maintenance previously performed is greater than or equal to a first threshold value, and performs second maintenance stronger than the first maintenance in a case in which the consumption amount is less than the first threshold value.

2. The liquid discharge device according to claim 1, comprising a setting input unit for a user to set a time to perform the maintenance.

3. The liquid discharge device according to claim 1, wherein the control unit includes a storage unit configured to store time zones during which a power source is on and the liquid discharge device is not in use, and the control unit performs the maintenance in any time zone among the time zones stored in the storage unit.

4. The liquid discharge device according to claim 3, wherein the storage unit is configured to store the time zones in a plurality of days, and the control unit is configured to perform the maintenance in a time zone that happened a greatest number of times, among the time zones in the plurality of days.

5. The liquid discharge device according to claim 1, wherein when performing the maintenance in accordance with a user's instruction, the control unit performs third maintenance in a case in which a consumption amount of the liquid consumed during a predetermined period prior to the user's instruction is greater than or equal to a second threshold value, and performs fourth maintenance stronger than the third maintenance in a case in which the consumption amount of the liquid consumed during the predetermined period prior to the user's instruction is less than the second threshold value.

6. The liquid discharge device according to claim 1, comprising:

a liquid accommodation body including an accommodation chamber configured to accommodate the liquid injected from an injection port; and a supply flow path configured to couple the discharge unit and the liquid accommodation body.

7. A liquid discharge device, comprising:

a discharge unit configured to discharge liquid;

a maintenance unit configured to perform maintenance of the discharge unit by discharging liquid from the discharge unit; and a control unit configured to cause the maintenance unit to perform the maintenance when an unused time, which is a time when the liquid discharge device is not used, exceeds a threshold time, wherein when performing the maintenance, the control unit performs first maintenance in a case in which a consumption amount of the liquid consumed during a predetermined period before the liquid discharge device is unused is greater than or equal to a first threshold value, and performs second maintenance stronger than the first maintenance in a case in which the consumption amount is less than the first threshold value.

8. A liquid discharge device, comprising:

a discharge unit configured to discharge liquid;

a maintenance unit configured to perform maintenance of the discharge unit by discharging liquid from the discharge unit; and a control unit configured to cause the maintenance unit to perform the maintenance, wherein when performing the maintenance in accordance with a user's instruction, the control unit performs third maintenance in a case in which a consumption amount of the liquid consumed during a predetermined period prior to the user's instruction is greater than or equal to a second threshold value, and performs fourth maintenance stronger than the third maintenance in a case in which the consumption amount is less than the second threshold value.

* * * * *